US009996995B2

(12) United States Patent
Peng et al.

(10) Patent No.: US 9,996,995 B2
(45) Date of Patent: Jun. 12, 2018

(54) DOOR-LOCK CONTROL METHOD

(71) Applicant: BRAINCHILD ELECTRONIC CO., LTD., Taipei (TW)

(72) Inventors: Tsu-Yi Peng, Taipei (TW); Susan Dong, Taipei (TW)

(73) Assignee: BRAINCHILD ELECTRONIC CO., LTD., Taipei (TW)

( * ) Notice: Subject to any disclaimer, the term of this patent is extended or adjusted under 35 U.S.C. 154(b) by 97 days.

(21) Appl. No.: 15/043,780

(22) Filed: Feb. 15, 2016

(65) Prior Publication Data

US 2017/0161975 A1 Jun. 8, 2017

(30) Foreign Application Priority Data

Dec. 3, 2015 (TW) ..... 104140628 A

(51) Int. Cl.
*G07C 9/00* (2006.01)
*E05B 47/00* (2006.01)

(52) U.S. Cl.
CPC ..... *G07C 9/00111* (2013.01); *E05B 47/0012* (2013.01); *G07C 9/00309* (2013.01);
(Continued)

(58) Field of Classification Search
CPC ..... G07C 9/00111; G07C 9/00309; E05B 47/0012
(Continued)

(56) References Cited

U.S. PATENT DOCUMENTS

2008/0084299 A1* 4/2008 Fisher ..... E05B 47/02 340/542
2010/0148921 A1* 6/2010 Bliding ..... E05B 49/00 340/5.7
(Continued)

FOREIGN PATENT DOCUMENTS

CN 103617659 A 3/2014
TW I343444 B 6/2011
(Continued)

OTHER PUBLICATIONS

Office Action dated Aug. 17, 2016 of the corresponding Taiwan patent application.
(Continued)

*Primary Examiner* — Steven Lim
*Assistant Examiner* — Willard Edwards, Jr.
(74) *Attorney, Agent, or Firm* — Chun-Ming Shih; HDLS IPR Services

(57) ABSTRACT

A door-lock control method adopted by a door-lock device and a computer program is present. The method comprises: broadcasting a connecting message in a WPAN at the door-lock device; controlling a mobile device to establish a connection with the door-lock device via the WPAN when receiving the connecting message at the computer program; sending an unlocking command via the connection at the computer; and unlocking a door-lock thereon when receiving the unlocking command at the door-lock device. This application can omit the operations which the householder needs to do manually on the mobile device or the door-lock device, and effectively improves the convenience of use and reduces the waiting time of completing unlocking the door-lock.

9 Claims, 6 Drawing Sheets

(52) U.S. Cl.
CPC .... *G07C 9/00896* (2013.01); *E05B 2047/002* (2013.01); *E05B 2047/0048* (2013.01); *E05B 2047/0068* (2013.01); *E05B 2047/0089* (2013.01); *E05B 2047/0091* (2013.01); *E05B 2047/0095* (2013.01); *G07C 2009/00793* (2013.01); *G07C 2209/62* (2013.01); *G07C 2209/63* (2013.01)

(58) Field of Classification Search
USPC ..... 340/5.61
See application file for complete search history.

(56) References Cited

U.S. PATENT DOCUMENTS

| | | | | |
|---|---|---|---|---|
| 2014/0035302 | A1* | 2/2014 | Koch | E05B 15/022 292/341.17 |
| 2017/0032602 | A1* | 2/2017 | Cheng | G07C 9/00182 |

FOREIGN PATENT DOCUMENTS

| | | | |
|---|---|---|---|
| TW | M483988 | U | 8/2014 |
| TW | M494819 | U | 2/2015 |
| TW | M502294 | U | 6/2015 |
| TW | M504297 | U | 7/2015 |

OTHER PUBLICATIONS

Office Action dated Aug. 3, 2017 of the corresponding China patent application No. 201511002023.7.

* cited by examiner

DOOR-LOCK CONTROL METHOD

BACKGROUND OF THE INVENTION

Field of the Invention

The technical field relates to method and more particularly related to door-lock control method.

Description of Related Art

In the related art, an electronic locking system having the ability to unlock without using any mechanical key had been developed. For unlocking a door-lock, a household first must operate the household's smart phone for making the smart phone establish a Bluetooth connection with a door-lock device. And then, after the Bluetooth connection is established, the household operates the smart phone to control the door-lock device to unlock.

However, comparing with a traditional mechanical lock using the mechanical key, the electronic locking system of the related art still did not have satisfactory convenience because the household still must operate the smart phone directly. Besides, because the household must wait for completion of establishing the Bluetooth connection after completing the operation, an unlocking time of the electronic locking system of the related art is longer than an unlocking time of the traditional mechanical lock.

Therefore, the electronic locking system of the related art has above-mentioned problems. There is a need to find out a better and more effective solution to handle such problems.

SUMMARY OF THE INVENTION

The object of the present disclosed example is to provide a door-lock control method having ability of automatically unlocking when detecting that a household goes home.

In order to achieve the above objective, a door-lock control method used in a door-lock device installed on a door and a computer program installed in a mobile device is provided which comprises following steps of: a) the door-lock device broadcasting a connecting message in a wireless personal area network; b) the computer program controlling the mobile device to establishing a connection with the door-lock device via the wireless personal area network when receiving the connecting message; c) the computer program automatically sending an unlocking command via the connection after successfully establishing the connection; and d) the door-lock device unlocking a door-lock when receiving the unlocking command and detecting that a household approaches.

This application can omit the operations which the householder needs to do manually on the mobile device or the door-lock device, and effectively improves the convenience of use and reduces the waiting time of completing unlocking the door-lock.

BRIEF DESCRIPTION OF DRAWING

The features of the present disclosed example believed to be novel are set forth with particularity in the appended claims. The present disclosed example itself, however, may be best understood by reference to the following detailed description of the present disclosed example, which describes an exemplary embodiment of the present disclosed example, taken in conjunction with the accompanying drawings, in which:

DETAILED DESCRIPTION OF THE INVENTION

In cooperation with attached drawings, the technical contents and detailed description of the present disclosed example are described thereinafter according to a preferable embodiment, being not used to limit its executing scope. Any equivalent variation and modification made according to appended claims is all covered by the claims claimed by the present disclosed example.

Figure 1:
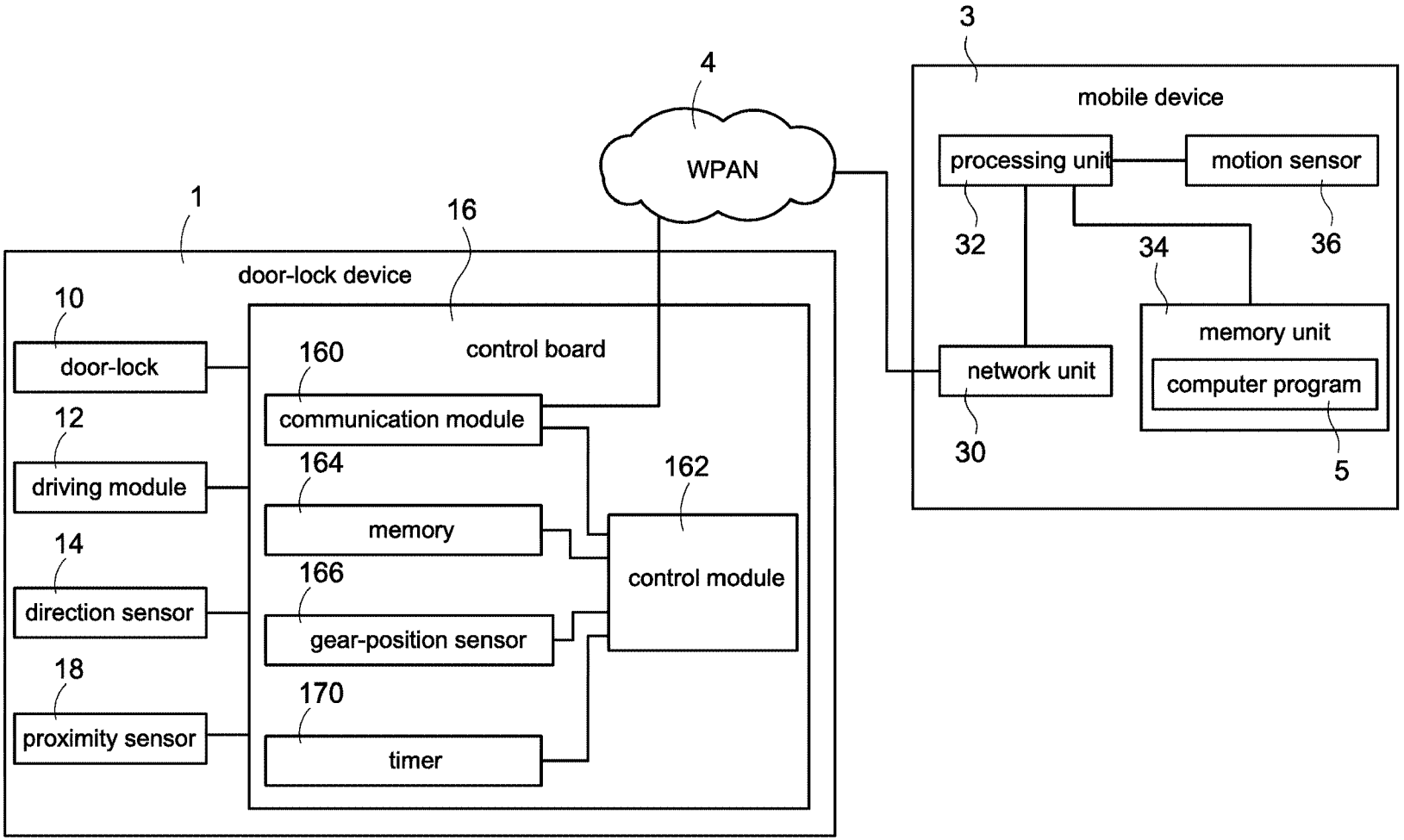
FIG. 1 is an architecture diagram of a door-lock system according to an embodiment of the present disclosed example.
Figure 2:
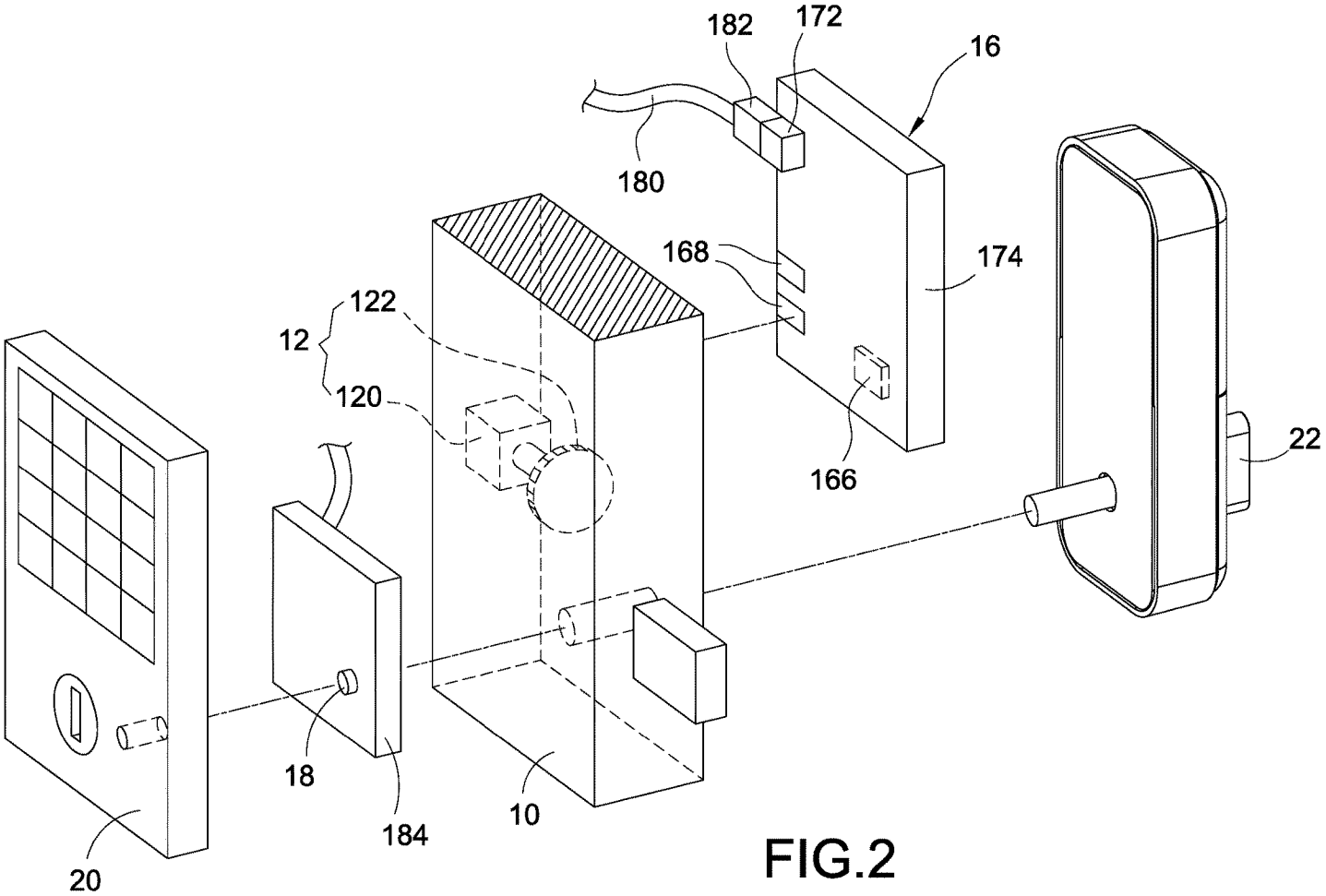
FIG. 2 is a schematic view of a door-lock device according to an embodiment of the present disclosed example.

First, please simultaneously refer to FIG. 1 and FIG. 2, which FIG. 1 illustrates an architecture diagram of a door-lock system according to an embodiment of the present disclosed example, FIG. 2 illustrates a schematic view of a door-lock device according to an embodiment of the present disclosed example.

As shown in the figures, the disclosed example discloses a door-lock system mainly comprising a door-lock device 1 and a computer program 5. The door-lock device 1 is installed on a door of the entrance of house. The computer program 5 is installed in a mobile device 3 hold by the household. Preferably, the mobile device 3 is smart phone, tablet or wearable device (such as smart watch, smart watch, smart wristband, smart ring or smart glasses), but this specific example is not intended to limit the scope of the disclosed example.

The door-lock device 1 comprises a door-lock 10, a driving module 12, a direction sensor 14 and a control board 16. The driving module 12 is connected to the door-lock 10 for unlocking/locking the door-lock 10. More specifically, the driving module 12 comprises a driving element 120 (such as motor) and at least one gear 22 gearing the door-lock 10. The driving element 120 drives the gear 122 to gear a cylinder structure of the door-lock 10 for unlocking/locking.

The direction sensor 14 senses a current angle of the door. Preferably, the direction sensor 14 is gyroscope, accelerometer, geomagnetism-sensing meter or any combination of above-mentioned devices, but this specific example is not intended to limit the scope of the disclosed example. When the direction sensor 14 is gyroscope or geomagnetism-sensing meter, the direction sensor 14 can directly sense a rotational angle of the door. When the direction sensor 14 is accelerometer, the direction sensor 14 can sense an acceleration value of the door and calculate a corresponded rotational angle. For example, the direction sensor 14 can transfer the sensed acceleration value to the control board 16 for calculating.

The control board 16 mainly comprises a communication module 160, a memory 164 used to store data and a control module 162 electrically connected to above-mentioned elements. The communication module 160 connects to a wireless personal area network (WPAN) 4 (referred to as wireless network 4 in following description) and performs data transmission via the wireless network 4. Preferably, the communication module 160 is Bluetooth transceiver, ZigBee transceiver or Wi-Fi transceiver (such as using the Wi-Fi Direct technology), but this specific example is not intended to limit the scope of the disclosed example.

Control module 162 electrically connected to the driving module 12 and direction sensor 14 controls the door-lock device 1. More specifically, the control module 162 can continuously broadcasts a connecting message in the wireless network 4 via the communication module 160 such that the computer program 5 automatically establishes a connection with the door-lock device 1 and sends an unlocking command to the door-lock device 1 (described later) according to the connecting message. Additionally, when the control module 162 receives the unlocking command from the computer program 5, the control module 162 can control the driving module 12 to unlock the door-lock 10 for implementing automatically unlocking function. Preferably, the broadcasted message comprises necessary software/hardware information (such as Device ID, MAC address or connection password) used to establish the connection with the control board 16 of the door-lock device 1.

Besides, when detecting the closed status of the door via the direction sensor 14, the control module 12 can control the driving module 12 to lock the door-lock 10 for implementing automatically locking function. Preferably, the control module 162 controls the driving module 12 to lock the door-lock 10 when detecting that the door had moved (for example, a household closed the opened door) and the door has closed currently. Or, the control module 162 controls the driving module 12 to lock the door-lock 10 when failing to receive the unlocking command (such as failing to receive the unlocking command for 30 seconds) and detecting that the door has closed.

Preferably, the control module 162 retrieves the current rotational angle of the door via the direction sensor 14, and determines whether the door has closed according to the retrieved rotational angle. For example, the control module 12 determines that the door has closed when the rotational angle is less than a default angle (such as 1 angle).

Computer program 5 is stored in the memory unit 34 of the mobile device 3. After the computer program 5 is executed by the processing unit 32 of the mobile device 3, the computer program 5 can control the mobile device 3 to scan in the wireless network 4 via the network unit 30 (such as Bluetooth transceiver, ZigBee transceiver or Wi-Fi transceiver) for receiving the connecting message broadcasted from the door-lock device 1. Then, the computer program 5 can control the mobile device 3 to establish above-mentioned connection with the door-lock device 1 in the wireless network 4 according to the received connecting message. After successfully establishing the connection, the computer program 5 automatically sends an unlocking command to the door-lock device 1 via above-mentioned connection for unlocking.

Please be noted that because the wireless network 4 (WPAN) has the characteristics comprising short-distance transmission, small coverage and so forth, when the mobile device 3 hold by the household can detect the wireless network 4, the status represents that the household approached the door-lock device 1 (such as the entrance of the house nearby). Via making the mobile device 3 voluntarily/automatically start to perform unlocking operation when detecting the wireless network 4 (in other words, perform the unlocking operation in advance of achieving the entrance of the house), the disclosed example can effectively complete the unlocking operation before the household achieves the entrance of the house. Thus, when achieving the entrance of the house, the household can directly enter the house without waiting and manually unlocking so as to effectively reduce the waiting time of completing unlocking the door-lock and improve the convenience of use.

In another embodiment of the disclosed example, the computer program 5 can further control the mobile device 3 to detect whether the mobile device 3 continuously moves via the motion sensor 36 of the mobile device 3. For example, the household currently locates outside of the door and continues to move in a direction close to the door. Additionally, the computer program 5 controls the mobile device 3 to send the unlocking command to the door-lock device 1 when receiving the connecting message from the door-lock device 1 and detecting that the mobile device 3 continuously moves. Thus, this disclosed example can effectively prevent the household from involuntary unlocking the door-lock 1 caused by placing the mobile device 3 at a place near the door-lock device 1 (such as porch).

In another embodiment of the disclosed example, the mobile device 1 further comprises a proximity sensor 18 electrically connected to the control broad 16. The proximity sensor 18 can trigger signal to the control broad 16 when detecting that the household approaches. Preferably, the proximity sensor 18 is optical reflecting proximity sensor, but this specific example is not intended to limit the scope of the disclosed example. Additionally, in this embodiment, the control module 162 is to control the driving module 12 to unlock door-lock 10 when receiving both the unlocking command from the mobile device 3 and the triggered signal from the proximity sensor 18. Furthermore, the control module 162 can further control the driving module 12 to lock the door-lock 10 when detecting that the door has closed and fails to receive the triggered signal, for example, the household is not near the door. Thus, this disclosed example can effectively prevent the thief from entering the house caused by the door-lock 10 being early unlocked before the household achieves, and prevent the household from being obstructed at the outside of the door caused by the door-lock device 1 misjudging that the household has gone out and locks the door-lock 10. For example, the household doesn't actually go out and involuntary or temporarily closes the door (such as signing for parcel, trimming garden or checking mailbox).

In another embodiment of the disclosed example, the control broad 16 further comprises a gear-position sensor 166 electrically connected to the control module 162 and installed close to the gear 122. The gear-position sensor 166 senses the current rotational direction and position of the gear 122. Preferably, the gear-position sensor 166 is opto-interrupter sensor, electromagnetic sensor or micro-switch, and can sense the rotational angle of the gear 122 as the current position of the gear 122, but this specific example is not intended to limit the scope of the disclosed example.

Furthermore, when the gear-position sensor 166 is opto-interrupter sensor, the gear-position sensor 166 comprises an optical grating. The gear 122 comprises a plurality of light-interrupting elements for positioning. For example, the light-interrupting elements be arranged and installed according to the default angle difference. Thus, when the gear 122 is rotating, the gear 122 can gear the light-interrupting elements to sequentially interrupt above-mentioned optical grating to make the gear-position sensor 166 compute the current rotational angle according to the interrupting times. When the gear-position sensor 166 is electromagnetic sensor, the gear-position sensor 166 comprises a magnetic inducting element. The gear 122 comprises a plurality of magnets. Thus, when the gear 122 is rotating, the gear 122 can gear the magnets to sequentially magnetically attract the magnetic inducting element to make the gear-position sensor 166 compute the current rotational angle according to the attracting times of the magnetic inducting element. When the gear-position sensor 166 is micro-switch, the gear-position sensor 166 comprises a switch element. The gear 122 comprises a plurality of switch-toggling elements. Thus, when the gear 122 is rotating, the gear 122 can gear the switch-toggling elements to sequentially toggle the switch element to make the gear-position sensor 166 compute the current rotational angle according to the toggling times of the switch element.

Additionally, in this embodiment, the control module 162 determines that the door-lock 10 has unlocked when determining the current position of the gear 122 is consistent with the default unlocking position, and determines that the door-lock 10 has locked when determining the current position of the gear 122 is consistent with the default locking position. The control module 160 unlocks the door-lock 10 when receiving the unlocking command and determining that the door-lock 10 has locked, and locks the door-lock 10 when determining that the door had moved, the door currently has closed and the door-lock 10 has unlocked.

Via making the status of the door-lock 10 as the parameter about automatically locking/unlocking the door-lock, this disclosed example can effectively omit meaningless operation (such as performing the locking operation to the locked door-lock 10, or performing the unlocking operation to the unlocked door-lock 10) to prevent the door-lock 1 from failing caused by above-mentioned meaningless operation.

Please refer to FIG. 2, in another embodiment of the disclosed example, each element of the control broad 16 is integrated in an independent single circuit board 174, the circuit board 174 is installed in the backside (near the inside of house) of the door-lock device 1 and is close to the position of the driving module 12. Additionally, proximity sensor 18 is instated in another independent circuit board 184, the circuit board 184 is installed in the front-side (near the outside of house) of the door-lock device 1 and is close to a door-lock interface (such as keyhole structure, password-inputting keypad or access control card reader) and connected to the control broad 16 via a cable 180. More specifically, the control broad 16 can further comprise a connecting port 172, the cable 180 can comprise a connector 182 used to removably connect to above-mentioned connecting port 172.

Additionally, in this embodiment, the control broad 16 can further comprise a gear-position sensor 166 and a set of electrical contact(s) 168. After the door-lock device 1 of this embodiment is completed to assemble, the gear-position sensor 166 is close to or touched the gear 122, the electrical contact 168 can be externally connected to the driving element 120. Thus, the control broad 16 can control the external driving element 120 via the electrical contact 168, and sense the current position of the external gear 122 via the gear-position sensor 166.

As mentioned above, because both the control broad 16 and the proximity sensor 18 of this disclosed example can be independently installed in the outside of the driving module 12 and the door-lock 10, this disclosed example can upgrade the current electronic door-lock to the door-lock having ability to automatically unlock/lock the door-lock without modifying the lock structure of the current electronic lock, and effectively omit the cost of the household installing the all new door-lock device.

In another embodiment of the disclosed example, the door-lock device 1 further comprises thumbturn cylinder 22. The thumbturn cylinder 22 is connected to the door-lock 10 and gears to the gear 122 for providing the household to unlock or lock at the inside of the house.

Figure 3:
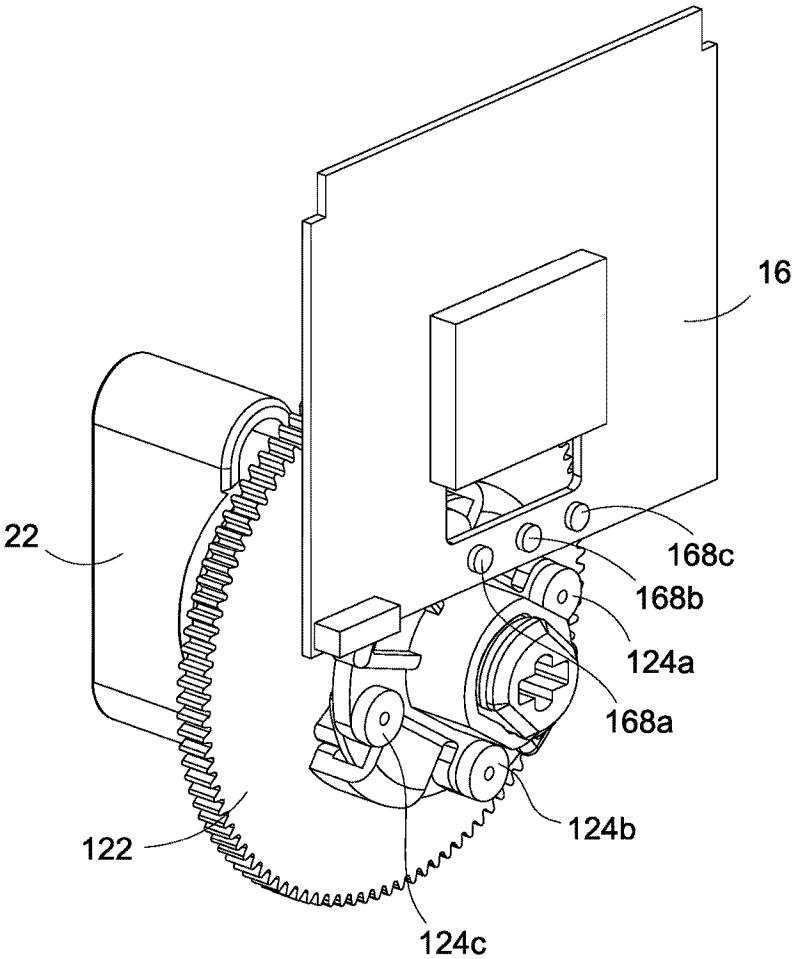
FIG. 3 is an arranged schematic view of a control board and a gear according to an embodiment of the present disclosed example.

Please refer to the FIG. 3, which illustrates an arranged schematic view of a control board and a gear according to an embodiment of the present disclosed example. As shown in the figure, in this embodiment, the door-lock 10 is two-direction lock which can simultaneously apply to the leftward opening door and rightward opening door, and the gear 122 of the driving module 12 can be rotated along clockwise or anticlockwise direction to gear the door-lock 10 to lock.

Please be noted that when the two-direction lock is installed in the leftward opening door, both the locking direction and the unlocking direction are just the opposite of the rightward opening door. Thus, this disclosed example further provides an automatically learning function of two-direction lock so as to make the door-lock device 1 have ability to recognize the correct locking direction and unlocking direction (in other words, the door-lock device 1 can recognize the current installed door is leftward opening door or rightward opening door) and correctly perform automatically door-unlocking or door-locking operation.

More specifically, a plurality of sensing magnets are arranged and installed on the gear 122 (take three sensing magnets 124*a*-124*c* for example), a plurality of positioning magnets are arranged and installed on the control broad 16 (take three positioning magnets 168*a*-168*c* for example). The number of sensing magnets 124*a*-124*c* and the number of positioning magnets 168*a*-168*c* can be the same or be different. Additionally, the control module 162 is electrically connected to the positioning magnets 168*a*-168*c* for detecting whether the positioning magnets attracts the sensing magnets 124*a*-124*c*.

Furthermore, after entering to a learning mode, the door-lock device 1 can receive the locking operation via the thumbturn cylinder 22. After receiving the locking operation, the gear 122 will be rotated along the locking direction (take clockwise for example) to the locking position and so as to make one of the sensing magnets 124*a*-124*c* attracts or repulses one of the positioning magnets 168*a*-168*c* (take the sensing magnet 124*a* attracting the positioning magnet 168*c* for example). Then, the door-lock device 1 can receive the unlocking operation from the household via the thumbturn cylinder 22. After receiving the unlocking operation, the gear 122 will be rotated along the unlocking direction (take anticlockwise for example) to the unlocking position and so as to make another one of the sensing magnets 124*a*-124*c* attracts or repulses another one of the positioning magnets 168*a*-168*c* (take the sensing magnet 124*b* attracting the positioning magnet 168*b* for example).

Then, the control module 162 will configure the positioning magnet 168*c* which is attracted or repulsed the sensing magnets when receiving the locking operation as a locking positioning magnet, and configure the positioning magnet 168*b* which is attracted or repulsed when receiving the unlocking operation as an unlocking positioning magnet. Thus, the control module 162 can recognize following information about the door-lock device 1: the locking direction being clockwise direction; the unlocking direction being anticlockwise direction, the position of the positioning magnet 168*b* being the unlocking position; and the position of the positioning magnet 168*c* being the locking position.

Furthermore, control module 16 stores above-mentioned information in the memory 164.

Thus, the control module 162 can determine the status of the door-lock 10 (in other words, locking status or unlocking status) according to the above-mentioned information.

In another embodiment of the disclosed example, the door-lock device 1 can implement the automatically learning function of two-direction lock via only using the single positioning magnet (take only using the positioning magnet 168*a* for example). More specifically, the positioning magnet 168*a* has the specific magnetism (take South pole magnetism for example), the sensing magnets 124*a*-124*c* are arranged and installed according to its magnetism. Preferably, the adjacent sensing magnets respectively have the relative magnetic poles. For example, the sensing magnet 124*a* has South pole magnetism, the sensing magnet 124*b* has North pole magnetism and the sensing magnet 124*c* has South pole magnetism.

Furthermore, after the door-lock device 1 enters the learning mode, the door-lock device 1 can receive the locking operation from the household via the thumbturn cylinder 22. After receiving the locking operation, the gear 122 is rotated to the locking position along the locking direction (take rotating 180 angles along clockwise direction for example) so as to make the sensing magnets 124*a*-124*c* move and generate a continuous first magnetic field variation to the positioning magnet 168*b*. In other words, the positioning magnet 168*b* having South pole magnetism first senses the repulsed magnetic field caused by the sensing magnet 124*a* having the same South pole magnetism, and senses the attracted magnetic field caused by the sensing magnet 124*b* having the different North pole magnetism.

Then, the door-lock device 1 receives the unlocking operation from the household via the thumbturn cylinder 22. After receiving the locking operation, the gear 122 is rotated to the unlocking position along the unlocking direction (take rotating 180 angles along anticlockwise direction for example) so as to make the sensing magnets 124*a*-124*c* move and generate a continuous second magnetic field variation to the positioning magnet 168*b*. In other words, the positioning magnet 168*b* having South pole magnetism first senses the attracted magnetic field caused by the sensing magnet 124*b* having the different North pole magnetism, and senses the repulsed magnetic field caused by the sensing magnet 124*a* having the same South pole magnetism.

Then, the control module 162 makes the first magnetic field variation correspond to the locking operation, makes the second magnetic field variation correspond to the unlocking operation, and leaves the learning mode. Thus, the control module 162 can sense the current magnetic field variation via the positioning magnet 168*b*, determine that the door-lock 10 has locked when determining that the current magnetic field variation is consistent with the first magnetic field variation, and determining that the door-lock 10 has unlocked when determining that the current magnetic field variation is consistent with the second magnetic field variation.

In another embodiment of the disclosed example, the door-lock device 1 further comprises a timer 170 electrically connected to the control module 162. Additionally, the control module 162 automatically locks the door-lock 10 when detecting that the door has closed and timing at a default locking time (such as 3 seconds) via the timer 170. Thus, the household needs not unlock the door-lock 10 again after closing the door and becoming aware of something left in the house.

In another embodiment of the disclosed example, the control module 162 locks the door-lock 10 when detecting that the door has closed and the connection between the door-lock device 1 and the mobile device 3 is disconnected. Thus, this disclosed example can effectively automatically lock the door-lock 10 when the household is far away from house (in other words, the mobile device 3 locates at a place out of the coverage of the wireless network 4) so as to make the household needs not manually unlock when temporary returning the house.

Following description will explain the door-lock control method of this disclosed example. The door-lock control method in each embodiment of this disclosed example is mainly implemented by the system as illustrated in FIGS. 1-3. More specifically, the memory 164 of the door-lock device 1 further stores a door-lock computer program. After the mobile device 1 executes the computer program 5, and the door-lock device 1 executes the door-lock computer program, the door-lock control method in each embodiment of this disclosed example can be implemented.

Figure 4:
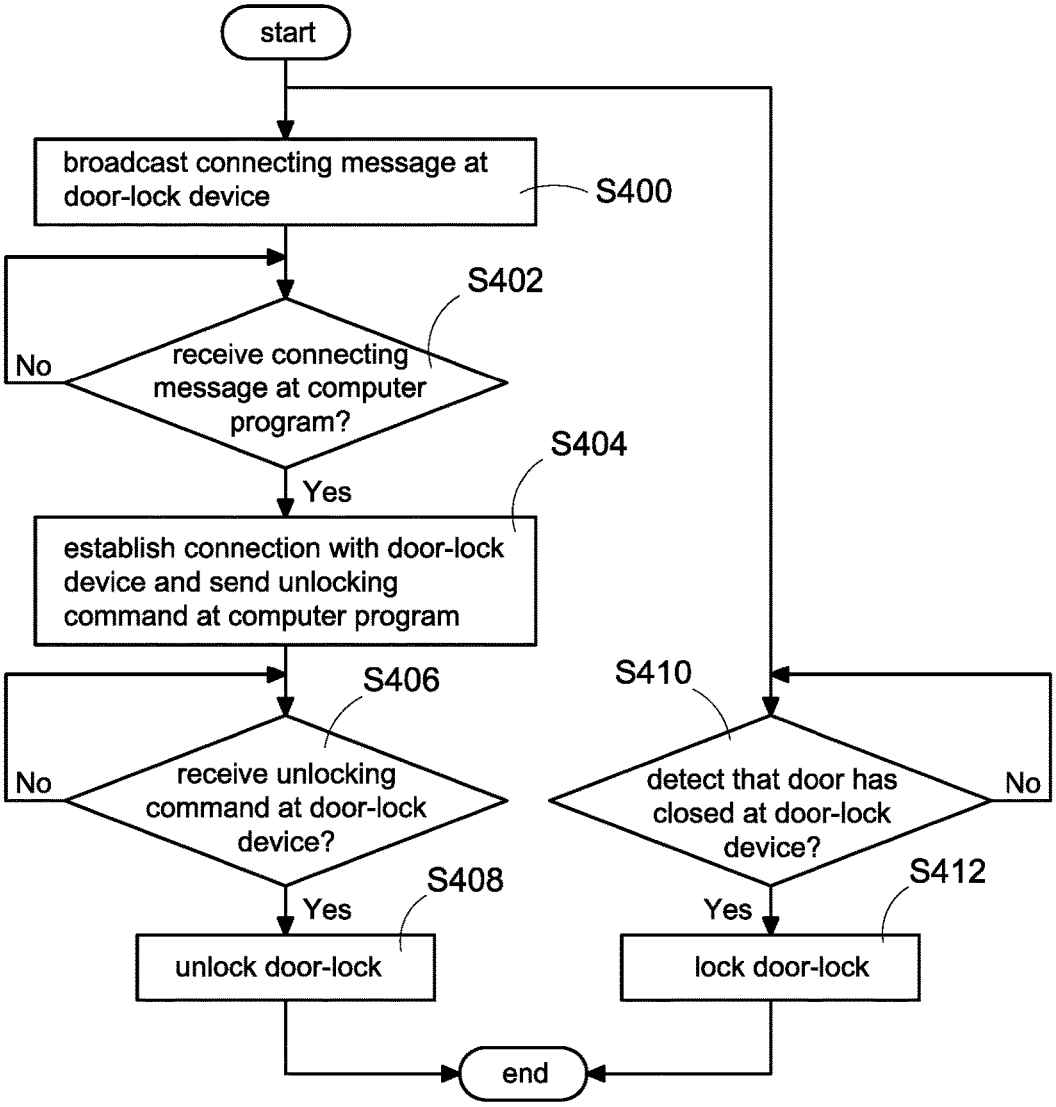
FIG. 4 is a flowchart of a door-lock control method according to an embodiment of the present disclosed example.

Please refer to FIG. 4, which illustrates a flowchart of a door-lock control method according to an embodiment of the present disclosed example. The door-lock control method of this embodiment mainly comprises steps S400-S408 used to implement the automatically unlocking function and steps S410-S412 used to implement the automatically locking function. Additionally, there is no necessary order relation between the steps S400-S404 and the steps S410-S412, the steps S400-S404 and the steps S410-S412 can be simultaneously performed or sequentially performed, but this specific example is not intended to limit the scope of the disclosed example.

Step S400: the door-lock 1 broadcasts a connecting message in the wireless network 4.

Step S402: the computer program 5 controls the mobile device 3 to determine whether the broadcasted connecting message is received from the door-lock device 1. If the computer program 5 receives the connecting message, the method of the disclosed example performs the step S404. Otherwise, the method of the disclosed example performs the step S402 again for continuously determining.

Step S404: the computer program 5 controls the mobile device 3 to automatically establish a connection with the door-lock device 1 in the wireless network 4 for communication when receiving the connecting message. Furthermore, the computer program 5 controls the mobile device 3 automatically to send an unlocking command to the door-lock device 1 via the established connection.

Step S406: the door-lock device 1 determines whether the unlocking command is received via the connection. If the door-lock device 1 receives the unlocking command, the method of the disclosed example performs the step S408. Otherwise, the method of the disclosed example performs the step S406 again for continuously determining.

Step S408: the door-lock device 1 controls the driving module 12 to unlock the door-lock 10 when receiving the unlocking command.

Following description will explain the automatically locking function. Step S410: the door-lock device 1 determines whether the door has closed. Preferably, the door-lock device 1 first retrieves the current rotational angle of the door via the direction sensor 14, and determines whether the door has closed according to retrieved rotational angle. If the door-lock device 1 determines that the door has closed, the method of the disclosed example performs step S412. Otherwise, the method of the disclosed example performs step S410 again for continuously determining.

Preferably, the door-lock device 1 performs the step S412 if detecting that the door had moved and has closed currently. Otherwise, the method of the disclosed example performs the S410 again for continuously determining. Or, the control module 162 starts to detect whether the door has closed when detecting that the door had moved. After detecting that the door had moved (such as the opened door had been closed), the control module 162 controls the driving module 12 to lock the door-lock 10.

Step S412: the door-lock device 1 automatically controls the driving module 12 to lock door-lock 10 when detecting that the door has closed.

Figure 5A:
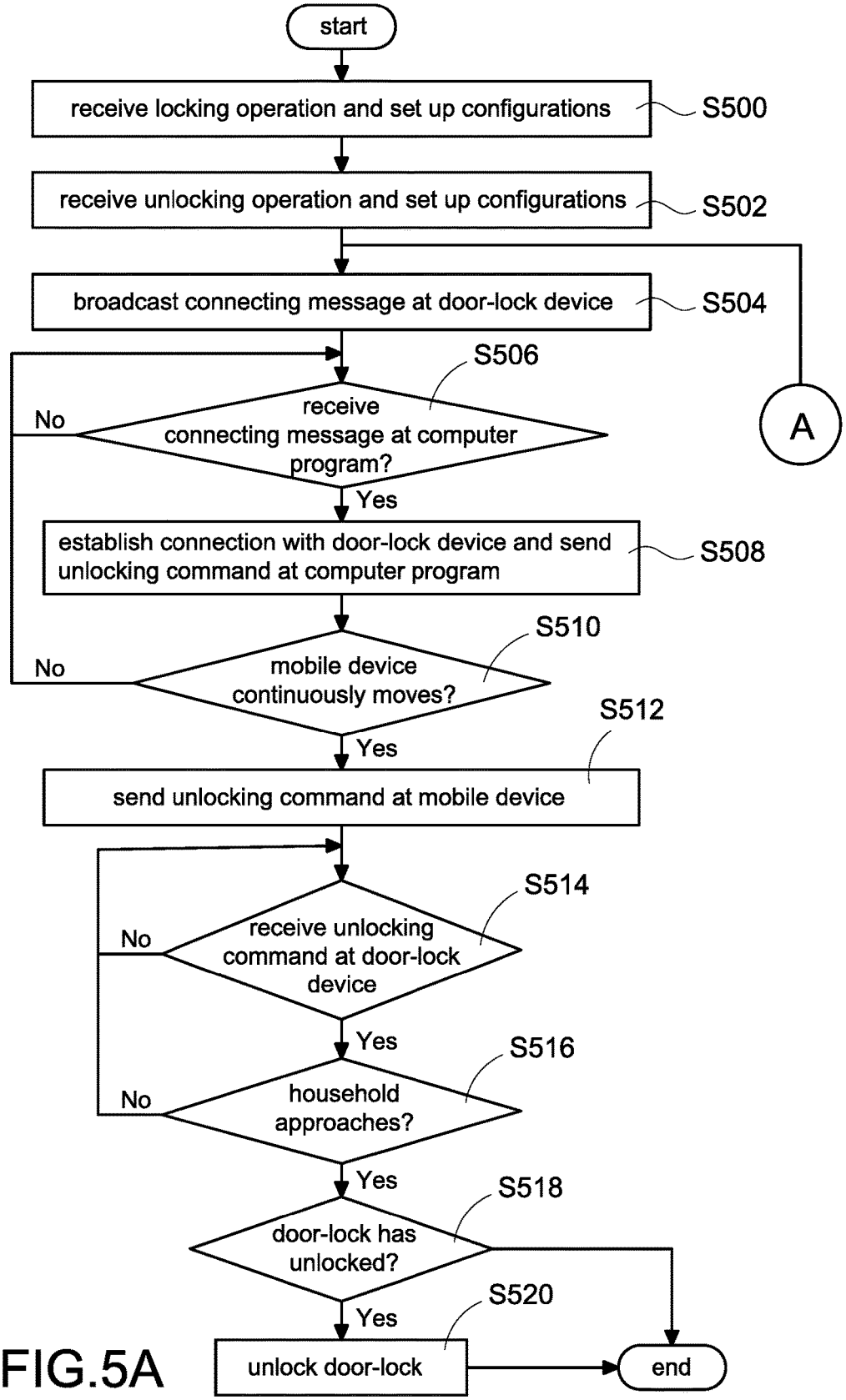
FIG. 5A is a first flowchart of a door-lock control method according to another embodiment of the present disclosed example.
Figure 5B:
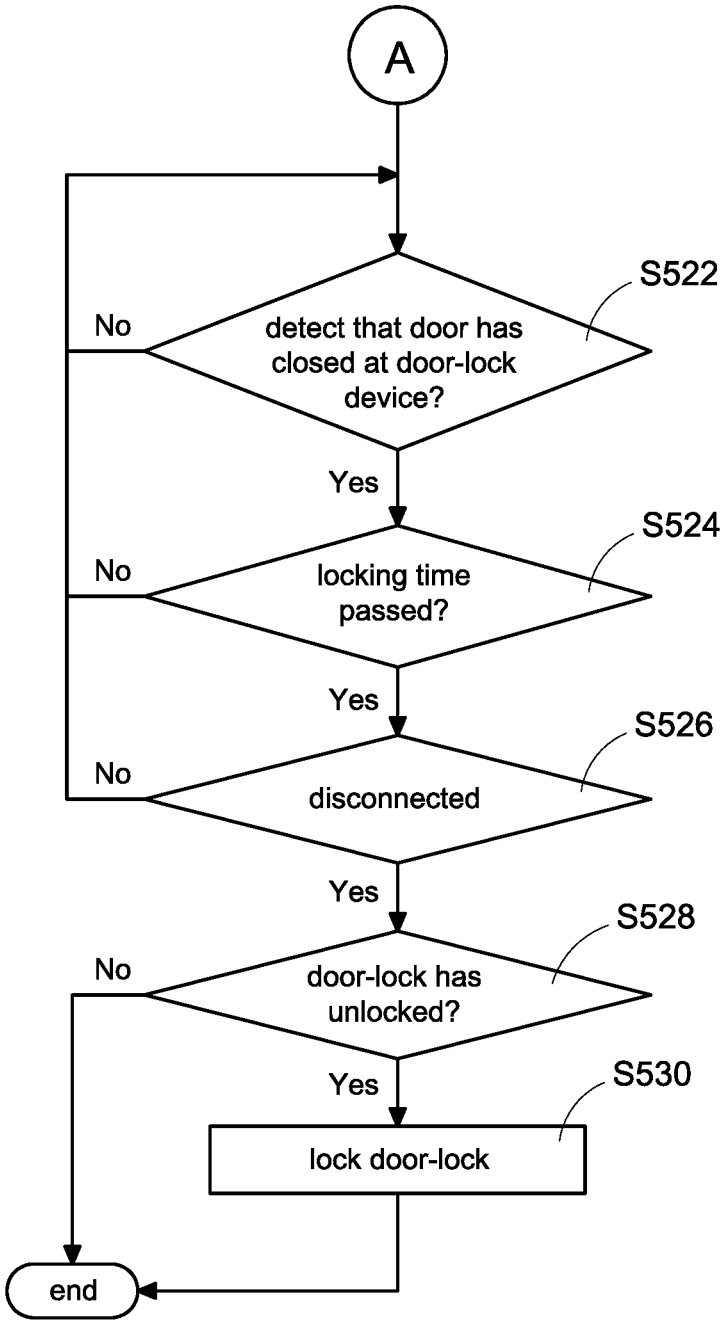
FIG. 5B is a second flowchart of a door-lock control method according to another embodiment of the present disclosed example.

Please simultaneously refer to FIG. 5A and FIG. 5B, which illustrates a flowchart of a door-lock control method according to another embodiment of the present disclosed example. The door-lock control method of this embodiment mainly comprises the steps S500-S502 used to implement the automatically learning function of two-direction lock, the steps S504-S520 used to implement the automatically unlocking function and the steps S522-S530 used to implement automatically locking function. Additionally, there is no necessary order relation between above-mentioned steps S504-S520 and above-mentioned steps S522-S530, the steps S504-S520 and the steps S522-S530 can be simultaneously performed or sequentially performed, but this specific example is not intended to limit the scope of the disclosed example.

Step S500: the door-lock device 1 receives a locking operation and sets up configurations.

More specifically, the door-lock device 1 receives the locking operation and senses a first magnetic field variation caused by all or parts of the sensing magnets 124*a*-124*c* via at least one positioning magnets 168*a*-168*c*, corresponds the first magnetic field variation to the locking operation and records them in the memory 164.

Preferably, the door-lock device 1 senses the first magnetic field variation caused by one of the sensing magnets 124*a*-124*b* and one of the positioning magnets 168*a*-168*c* attracting or repulsing each other. Then, the door-lock device 1 configures the attracted or repulsed positioning magnet as the locking positioning magnet for corresponding to the locking operation.

In another embodiment of the disclosed example, the adjacent sensing magnets 124*a*-124*c* respectively have the relative magnetic poles. The door-lock device 1 senses the continuously first magnetic field variation caused by moving the sensing magnets 124*a*-124*c*.

In another embodiment of the disclosed example, the door-lock device 1 receives the locking operation so as to make the gear 122 rotate to the specific position along the specific rotational direction. Then, the door-lock device 1 configures the current rotational direction as the locking direction, configures the current position as the locking position and records them in the memory 164.

Step S502: the door-lock device 1 receives the unlocking operation and sets up configurations.

More specifically, the door-lock device 1 receives the unlocking operation and senses a second magnetic field variation caused by all or parts of the sensing magnets 124*a*-124*c* via at least one positioning magnets 168*a*-168*c*, corresponds the second magnetic field variation to the unlocking operation and records them in the memory 164.

Preferably, the door-lock device 1 senses the second magnetic field variation caused by another one of the sensing magnets 124*a*-124*b* and another one of the positioning magnets 168*a*-168*c* attracting or repulsing each other. Then, the door-lock device 1 configures the attracted or repulsed positioning magnet as the unlocking positioning magnet for corresponding to the unlocking operation.

In another embodiment of the disclosed example, the adjacent sensing magnets 124*a*-124*c* respectively have the relative magnetic poles. The door-lock device 1 senses and records the continuously second magnetic field variation caused by moving the sensing magnets 124*a*-124*c*.

In another embodiment of the disclosed example, the door-lock device 1 receives the unlocking operation so as to make the gear 122 rotate to another specific position along another specific rotational direction. Then, the door-lock device 1 configures the current rotational direction as the unlocking direction, configures the current position as the unlocking position and records them in the memory 164.

Please be noted that there is no necessary order relation between the steps S500 and the steps S502. Additionally, the steps S500-S502 can be omitted when the door-lock device 1 is not two-direction lock.

Following description will explain the automatically unlocking function of this embodiment.

Step S504: the door-lock device 1 broadcasts a connecting message.

Step S506: the computer program 5 determines whether the connecting message is received. If receiving the connecting message, the method of the present disclosed example performs the step S508. Otherwise, the method of the disclosed example performs step S506 again for continuously determining.

Step S508: computer program 5 establishes a connection with the door-lock device 1.

Step S510: computer program 5 controls the mobile device 3 to detect whether the mobile device 3 continuously moves. Preferably, the mobile device 3 continuously moves in the direction of the door-lock device 1. If detecting that the mobile device 3 continuously moves, the method of the present disclosed example performs step S512. Otherwise, the method of the disclosed example performs step S506.

Step S512: computer program 5 sends unlocking command.

Step S514: the door-lock device 1 determines whether receive the unlocking command via the connection. If receive the unlocking command, the method of the disclosed example performs the step S516. Otherwise, the method of the disclosed example performs the step S514 again for continuously determining.

Step S516: the door-lock device 1 detects that whether the household approaches via the proximity sensor 18, namely, determines whether the mobile device 3 approaches. If detecting that the household approaches, the method of the present disclosed example performs step S518. Otherwise, the method of the present disclosed example performs step S514 again.

Step S518: the door-lock device 1 determines whether the door-lock 10 has locked.

More specifically, the door-lock device 1 detects the current magnetic field variation, and determines whether the detected magnetic field variation is consistent with the first magnetic field variation. If the detected magnetic field variation is consistent with the first magnetic field variation, the method of the present disclosed example determines that the door-lock 10 has locked. Otherwise, the method of the present disclosed example determines that the door-lock 10 has unlocked.

Preferably, the door-lock device 1 determines whether the pre-configured locking positioning magnet attracts or repulses one of the sensing magnets. If attracting or repulsing, the door-lock device 1 determines that the door-lock 10 has locked. Otherwise, the method of the disclosed example determines that the door-lock 10 has unlocked.

In another embodiment of the disclosed example, the door-lock device 1 makes determination according to the position of the gear 122. More specifically, the door-lock device 1 retrieves the current position of the gear 122 of the driving module 12 via the gear-position sensor 166, and retrieves the locking position pre-stored in the memory 164. Then, the door-lock device 1 determines whether the current position is consistent with the locking position. If the current position is consistent with the locking position, the method of the present disclosed example determines that the door-lock 10 has locked. Otherwise, the method of the present disclosed example determines that the door-lock 10 has unlocked.

If determine that the door-lock 10 has locked, the method of the disclosed example performs the step S520 for performing unlocking operation. If the door-lock device 1 determines that the door-lock 10 has unlocked, the unlocking operation won't be performed.

Step S520: the door-lock device 1 unlocks the door-lock 10.

Please be noted that there is no necessary order relation between the steps S514, S516 and S518, between the steps S506-S514 and S514-S518. Additionally, the step S516 and the step S518 are not the necessary steps. People having ordinary skill in the art of this disclosed example can arbitrarily modify the order of the step S514, S516 and S518, the order of step S506-S514 or the order of the step S514-S518, or omit the step S516 or the step S518 according to the people's requirement.

Following description will explain the automatically locking function of this embodiment.

Step S522: the door-lock device 1 detects whether the door has closed. If the door has closed, the method of the present disclosed example performs the step S524. Otherwise, the method of the present disclosed example performs the step S522 again.

Preferably, the door-lock device 1 performs the step S524 when detecting that the door had moved and the door has closed currently. Otherwise, the method of the disclosed example performs the step S522.

Step S524: the door-lock device 1 times whether a default locking time passed via the timer 170. If the locking time passed, the method of the disclosed example performs the step S526. Otherwise the method of the disclosed example performs step S522 again.

Step S526: the door-lock 1 detects whether the connection between the door-lock device 1 and the mobile device 3 is disconnected. If the connection is disconnected, the method of the disclosed example performs step S528. Otherwise, the method of the disclosed example performs step S522 again.

Step S528: the door-lock device 1 determines whether the door-lock 10 has unlocked.

More specifically, the door-lock device 1 detects the current magnetic field variation, and determines whether the current magnetic field variation is consistent with the second magnetic field variation. If they are consistent, the door-lock device 1 determines that the door-lock has unlocked. Otherwise, the door-lock device 1 determines that the door-lock 10 has locked.

Preferably, the door-lock device 1 determines whether the pre-configured positioning magnet attracts or repulses one of the sensing magnets. If the pre-configured positioning magnet attracts or repulses the sensing magnet, the door-lock device 1 determines that the door-lock 10 has unlocked. Otherwise, the door-lock device 1 determines that the door-lock has locked.

In another embodiment of the disclosed example, the door-lock device 1 determines according to the position of the gear 122. More specifically, the door-lock device 1 retrieves the current position of the gear 122 via the gear-position sensor 166, and retrieves pre-stored unlocking position from the memory 164. Then, the door-lock device 1 determines whether the current position is consistent with the unlocking position. If the current position is consistent with the unlocking position, the door-lock device 1 determines that the door-lock 10 has unlocked. Otherwise, the door-lock device 1 determines that the door-lock 10 has locked.

If the door-lock device 1 determines that the door-lock 10 has unlocked, the method of the disclosed example performs the step S530 for performing the locking operation. If the door-lock device 1 determines that the door-lock 10 has locked, the locking operation won't be performed.

Step S530: the door-lock device 1 locks the door-lock 10.

Please be noted that there is no necessary order relation between the steps S524, S526 and S526. Additionally, the step S526 and the step S528 are not the necessary steps. People having ordinary skill in the art of this disclosed example can arbitrarily modify the order of the step S524, S526 and S528 or omit the step S526 or the step S528 according to the people's requirement.

As the skilled person will appreciate, various changes and modifications can be made to the described embodiment. It is intended to include all such variations, modifications and equivalents which fall within the scope of the present disclosed example, as defined in the accompanying claims.

What is claimed is:

1. A door-lock control method used in a door-lock device installed on a door and a computer program installed in a mobile device, comprising:

a) the door-lock device receiving a locking operation and sensing a first magnetic field variation caused by all or parts of a plurality of sensing magnets arranged and installed on a gear via at least one positioning magnet arranged and installed on a control board of the door-lock device;

b) corresponding the first magnetic field variation to the locking operation;

c) receiving an unlocking operation and sensing a second magnetic field variation caused by all or parts of the sensing magnets via the at least one the positioning magnet;

d) corresponding the second magnetic field variation to the unlocking operation;

e) broadcasting a connecting message in a wireless personal area network;

f) the computer program controlling the mobile device to establishing a connection with the door-lock device via the wireless personal area network when receiving the connecting message;

g) the computer program automatically sending an unlocking command via the connection after successfully establishing the connection; and h) the door-lock device unlocking a door-lock when receiving the unlocking command, detecting via a proximity sensor that a household approaches, and detecting that the door-lock has been locked, wherein the door-lock device determines that the door-lock has been locked when a current magnetic field variation caused by all or parts of the sensing magnets is consistent with the first magnetic field variation.

2. The door-lock control method according to claim 1, wherein the step g) is to send the unlocking command when detecting that the mobile device continuously moves.

3. The door-lock control method according to claim 1, wherein the method further comprises a step i) the door-lock device locking the door-lock when detecting that the door had been moved and has been closed currently.

4. The door-lock control method according to claim 3, wherein the step i) is to lock the door-lock when detecting via a direction sensor that the door had been moved and the door currently has been closed, and detecting that the door-lock has been unlocked, wherein the door-lock device determines that the door-lock has been unlocked when the current magnetic field variation caused by all or parts of the sensing magnets is consistent with the second magnetic field variation.

5. The door-lock control method according to claim 4, wherein the step a) is to sense the first magnetic field variation caused by one of the sensing magnets and one of the positioning magnets attracting or repulsing each other;

the step b) is to configure the attracted or repulsed positioning magnet as a locking positioning magnet for making the first magnetic field variation correspond to the locking operation;

the step c) is to sense the second magnetic field varication caused by another sensing magnet and another positioning magnet attracting or repulsing each other;

the step d) is to configure the attracted or repulsed positioning magnet as an unlocking positioning magnet for making the second magnetic field variation correspond to the unlocking operation;

the step h) determines that the door-lock has been locked when determining that the locking positioning magnet attracts or repulses one of the sensing magnets;

the step i) determines that the door-lock has been unlocked when determining that the unlocking positioning magnet attracts or repulses one of the sensing magnets.

6. The door-lock control method according to claim 4, wherein the adjacent sensing magnets respectively have the relative magnetic poles; the step a) is to sense the continuously first magnetic field variation caused by moving the sensing magnets; the step c) is to sense the second magnetic field variation caused by moving the sensing magnets.

7. The door-lock control method according to claim 3, wherein the step i) is to retrieve a current rotational angle of the door and determine whether the door has been closed according to the rotational angle.

8. The door-lock control method according to claim 3, wherein the step i) is to lock the door-lock when detecting that the door had been moved, detecting that the door currently has been closed and a locking time elapses.

9. The door-lock control method according to claim 3, wherein the step i) is to lock the door-lock when detecting that the door had been moved, the door currently has been closed and the connection is disconnected.

* * * * *